US009613640B1

(12) United States Patent
Balamurali et al.

(10) Patent No.: US 9,613,640 B1
(45) Date of Patent: Apr. 4, 2017

(54) SPEECH/MUSIC DISCRIMINATION

(71) Applicants: Ramasamy Govindaraju Balamurali, Los Angeles, CA (US); Chandra Rajagopal, Los Angeles, CA (US)

(72) Inventors: Ramasamy Govindaraju Balamurali, Los Angeles, CA (US); Chandra Rajagopal, Los Angeles, CA (US)

(73) Assignee: AUDYSSEY LABORATORIES, INC., Los Angeles, CA (US)

( * ) Notice: Subject to any disclaimer, the term of this patent is extended or adjusted under 35 U.S.C. 154(b) by 0 days.

(21) Appl. No.: 14/995,509

(22) Filed: Jan. 14, 2016

(51) Int. Cl.

| | |
|---|---|
| ***G10L 21/00*** | (2013.01) |
| ***G10L 25/81*** | (2013.01) |
| ***G10L 25/21*** | (2013.01) |
| ***G10L 25/06*** | (2013.01) |
| ***G10L 19/26*** | (2013.01) |

(52) U.S. Cl.
CPC ..... *G10L 25/81* (2013.01); *G10L 19/26* (2013.01); *G10L 25/06* (2013.01); *G10L 25/21* (2013.01)

(58) Field of Classification Search
CPC ..... G10L 25/78; G10L 25/93; G10L 19/012; G10L 19/018; G10L 2025/932
USPC ..... 704/214; 381/303, 18, 1, 19
See application file for complete search history.

(56) References Cited

U.S. PATENT DOCUMENTS

| | | | | |
|---|---|---|---|---|
| 5,703,955 | A * | 12/1997 | Fels | H04S 3/02 381/1 |
| 5,826,230 | A | 10/1998 | Reaves | |
| 7,254,532 | B2 | 8/2007 | Fischer | |
| 8,468,014 | B2 | 6/2013 | Master | |
| 8,650,029 | B2 | 2/2014 | Thambiratnam | |
| 9,026,440 | B1 | 5/2015 | Konchitsky | |
| 2013/0304464 | A1 | 11/2013 | Wang | |
| 2015/0039304 | A1 | 2/2015 | Wein | |
| 2015/0162014 | A1 | 6/2015 | Zhang | |
| 2015/0264507 | A1 * | 9/2015 | Francombe | H04S 7/301 381/303 |

* cited by examiner

*Primary Examiner* — Charlotte M Baker
(74) *Attorney, Agent, or Firm* — Kenneth L. Green; Averill & Green

(57) ABSTRACT

A speech/music discrimination method evaluates the standard deviation between envelope peaks, loudness ratio, and smoothed energy difference. The envelope is searched for peaks above a threshold. The standard deviations of the separations between peaks are calculated. Decreased standard deviation is indicative of speech, higher standard deviation is indicative of non-speech. The ratio between minimum and maximum loudness in recent input signal data frames is calculated. If this ratio corresponds to the dynamic range characteristic of speech, it is another indication that the input signal is speech content. Smoothed energies of the frames from the left and right input channels are computed and compared. Similar (e.g., highly correlated) left and right channel smoothed energies is indicative of speech. Dissimilar (e.g., un-correlated content) left and right channel smoothed energies is indicative of non-speech material. The results of the three tests are compared to make a speech/music decision.

11 Claims, 3 Drawing Sheets

SPEECH/MUSIC DISCRIMINATION

BACKGROUND OF THE INVENTION

The present invention relates to audio signal processing and in particular to a method for detecting whether a signal includes speech or music to select appropriate signal processing.

Speech enhancement has been a long standing problem for broadcast content. Dialogue becomes harder to understand in noisy environments or when mixed along with other sound effects. Any static post-processing (e.g., fixed parametric equalizer) applied to the program material may improve the intelligibility of the dialogue but may introduce some undesirable artifacts into the non-speech portions. Known methods of classifying signal content as speech or music have not provided adequate accuracy.

BRIEF SUMMARY OF THE INVENTION

The present invention addresses the above and other needs by providing a speech/music discrimination method which evaluates the standard deviation between envelope peaks, loudness ratio, and smoothed energy difference. The envelope is searched for peaks above a threshold. The standard deviations of the separations between peaks are calculated. Decreased standard deviation is indicative of speech, higher standard deviation is indicative of non-speech. The ratio between minimum and maximum loudness in recent input signal data frames is calculated. If this ratio corresponds to the dynamic range characteristic of speech, it is another indication that the input signal is speech content. Smoothed energies of the frames from the left and right input channels are computed and compared. Similar (e.g., highly correlated) left and right channel smoothed energies is indicative of speech. Dissimilar (e.g., un-correlated content) left and right channel smoothed energies is indicative of non-speech material. The results of the three tests are compared to make a speech/music decision.

In accordance with one aspect of the invention, there is provided a method for classifying signal content as speech or non-speech in real time. The classification can be used with other post processing enhancement algorithms enabling selective enhancement of speech content, including (but not limited to) frequency-based equalization.

In accordance with another aspect of the invention, there is provided a method for classifying signal content as speech or non-speech in real time by evaluating the standard deviation between envelope peaks. Frames of N samples of an input signal are constructed. The left and right channels of input signals are band limited. A high-frequency roll-off point (e.g., 4 kHz) is determined by the highest meaningful frequencies of human speech. The low-end roll-off is significantly higher than the fundamental (lowest) frequencies of human speech—but is low enough to capture important vocal cues. The band limited left and right channels are used as the two inputs to a Least Mean Squared (LMS) filter. The LMS filter (with the appropriate step size and filter order parameters) has two outputs, a correlated content of the left and right channels and an error signal. The absolute values of the correlated content are taken, and normalized by the loudness of the LMS filter's output frame, to construct an envelope (where the loudness of a frame is the energy within a frame of data, weighted by a perceptual loudness filter). The envelope is searched for peaks above a specified threshold. The standard deviations of the separations between peaks are calculated. When this standard deviation decreases it is indicative of speech, whereas a higher standard deviation is indicative of non-speech material.

In accordance with yet another aspect of the invention, there is provided a method for classifying signal content as speech or non-speech in real time based on loudness ratios. The energy (RMS value) of each frame is calculated for each frame of the LMS filtered data, weighted by a perceptual loudness filter to obtain a measure of the loudness perceived by the typical human, and stored in a buffer. The buffer contains the M most recent energy calculations (the length M of the buffer is dictated by the longest gap between the syllables in speech). The ratio between maximum and minimum values in each buffer are calculated for the input signal. If this ratio corresponds to the dynamic range characteristic of speech, it is another indication that the input signal is speech content.

In accordance with still another aspect of the invention, there is provided a method for classifying signal content as speech or non-speech in real time based smoothed energy difference between input channels. Smoothed energies of the frames from the left and right input channels are computed and compared. Similar (e.g., highly correlated) left and right channel smoothed energies is indicative of speech. Dissimilar (e.g., un-correlated content) left and right channel smoothed energies is indicative of non-speech material.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
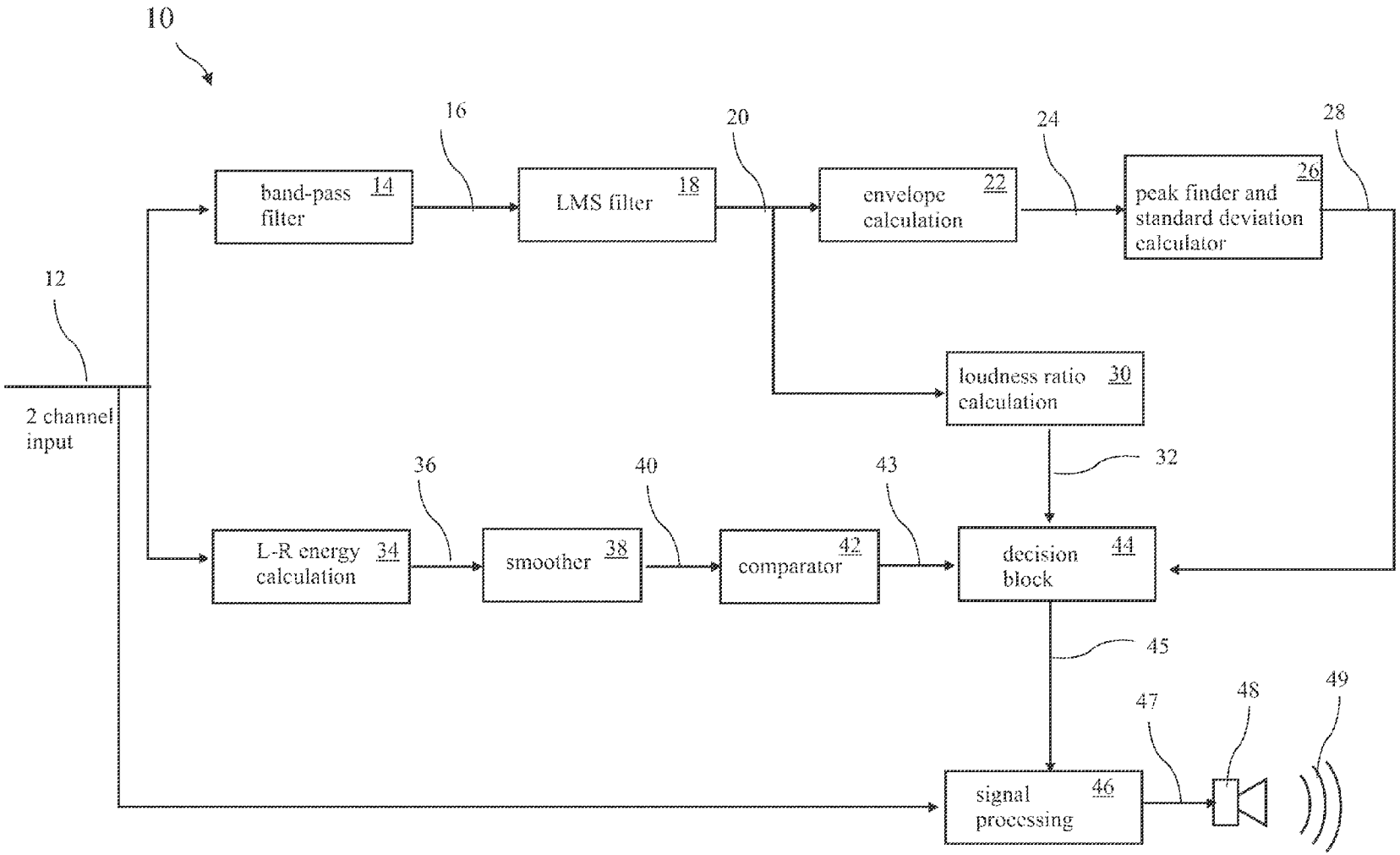
FIG. 1 shows a method for classifying speech/music content of a signal according to the present invention.

A method for classifying speech/music content of a signal according to the present invention is shown in FIG. 1. The method performs three tests on a two channel input signal 12, evaluating the standard deviation between envelope peaks, determining a loudness ratio between channels, and determining smoothed energy differences between channels. The input signal 12 is processed by a band-pass filter 14 producing band limited signal frames 16. A preferred length of the frames 16 is 512, but the length may vary depending on the sample rate of the input signal 12. The band limited signal frames 16 are processed by a Least Means Squared (LMS) filter 18 producing correlated data frames 20. The correlated data frames 20 are processed by envelope calculation 22 to produce a signal envelope 24. The signal envelope 24 is processed by peak finder and standard deviation calculator 26 to produce standard deviations of the separations between peaks which are an indication of the presence of speech in the input signal 12, and a peak separation flag or score 28 is produced. Small standard deviation values of the time between the peaks in the signal envelope 24 indicate closely occurring peaks in the envelope which are indicative of speech patterns. Larger values of the standard deviation values of the time between the peaks in the signal envelope 24 indicate the presence of musical content. For example, the peak separation flag 28 may be set to speech for standard deviation below 0.4 seconds and to non-speech for standard deviation above 0.4 seconds, or the score 28 may be set to the standard deviation and provided to the decision block 44 for use in a weighted decision process.

The correlated data frames 20 are further provided to a loudness ratio calculation 30 which processes the correlated data 20. The energy of each correlated data frame 20 of the LMS filter 18 is calculated and weighted with a perceptual loudness filter Revised Low-frequency B (RLB) weighting curve based on the International Telecommunications Union (ITU) standard (ITU-R BS.1770-2). The ratio between maximum and minimum values in each buffer are calculated for the input signal 12. If the ratio corresponds to the dynamic range characteristic of speech, it is another indication that the input signal is speech content, and a corresponding loudness ratio flag or score 32 is produced.

The input signal 12 is further provided to a left-right energy calculation 34 to produce channel energies 36. The channel energies 36 are smoothed by smoother 38 to produce smoothed energies 40 of the frames from the left and right input channels are computed and compared. The smoothed left and right channel energies 40 may be compared by comparitor 42 to provide a speech/non-speech flag 43, or the smoothed energies 40 of the left and right channels may be provided as a signal 43 for use in the weighted decision process. Similar (e.g., highly correlated) left and right channel smoothed energies is indicative of speech. Dissimilar (e.g., un-correlated content) left and right channel smoothed energies is indicative of non-speech material, and left-right channel energy flag or score 43 is produced.

While processing steps such as the comparitor 42 are shown as separate steps, those skilled in the art will recognize that reallocation of the processing steps is within the scope of the present invention. For example, the step of comparing the left and right channel energies described in the comparitor 42 can be reallocated to the decision block 44.

The peak separation flag or score 28, the loudness ratio flag or score 32, and the left-right channel energy flag or score 43 are provided to a decision block 44 where a speech versus music decision 45 is made for each frame of input data 12. The speech versus music decision 45 is provided to signal processing 46 which also receives the input signal 12. The signal processing 46 applies processing to the input signal 12 based on the speech versus music decision 45 to produce a processed signal 47. For example, speech specific frequency based equalization may be applied when the speech versus music decision 45 indicates that the input signal 12 includes speech. An example of speech specific frequency based equalization is a parametric EQ filter with variable gain at a fixed frequency to process the audio signal. When the decision block 44 outputs a speech flag 45 set to TRUE, parametric EQ filter may be enabled to enhance the intelligibility of speech. The decision flag could be also be combined with other dynamic processing techniques such as compressors and limiters.

The processed signal 47 is provided to a transducer 48 (for example an audio speaker) which produces sound waves 49.

The input signal 12 is broken into frames of N samples and the frames are processed by a band-pass filter 14 producing band limited signal frames 16. A high-frequency roll-off point (e.g., 4 kHz) is determined by the highest meaningful frequencies of human speech. The low-end roll-off is significantly higher than the fundamental (lowest) frequencies of human speech—but is low enough to capture important vocal cues.

Figure 2:
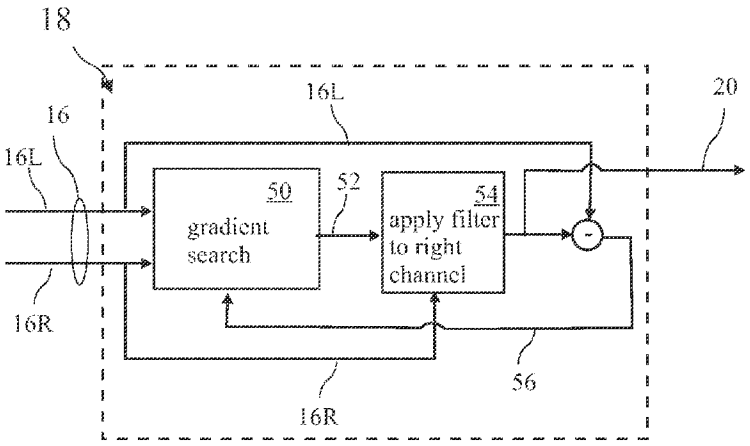
FIG. 2 shows a Least Mean Square (LMS) filter step of the method for classifying speech/music content of a signal according to the present invention.

The LMS filter 18 of the method for classifying speech/music content of a signal is shown in FIG. 2. The LMS filter 18 receives the band limited left and right signal frames 16L and 16R from the band-pass filter 14. The left and right band limited signal frames 16L and 16R are processed by a gradient search 50 to find filter weights 52. The filter weights 52 are applied to the band limited right signal 16R to obtain the correlated signal frames 20. The band limited left signal 16L is subtracted from the correlated signal 20 to generate an error signal 56 fed back to the gradient search 50. The correlated signal frames 20 are generally the same length as the left and right band limited signal frames 16L and 16R.

Figure 3:
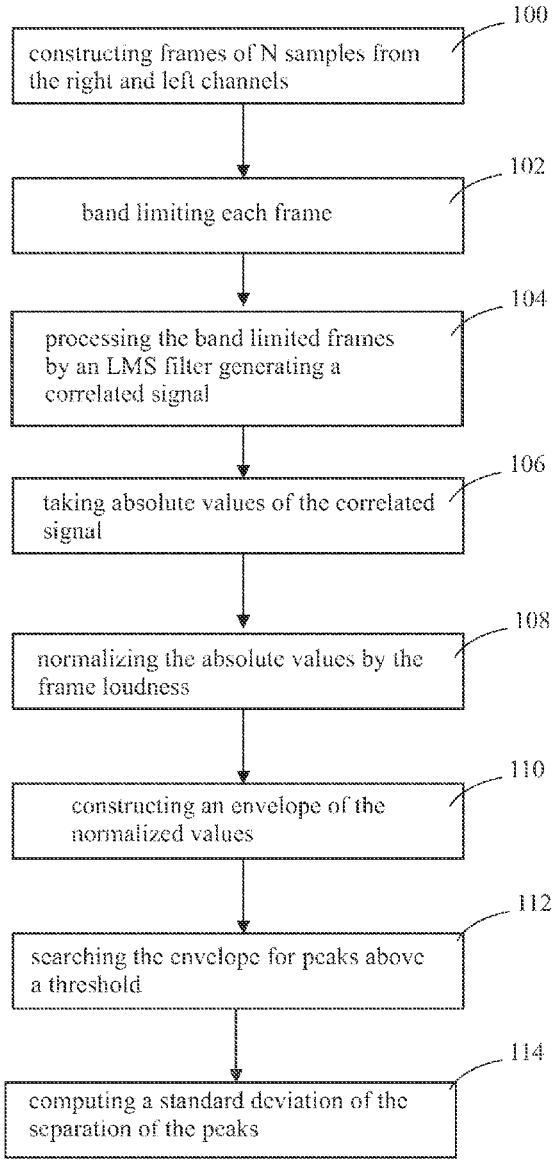
FIG. 3 is a method for obtaining a standard deviation of correlated left and right channel content according to the present invention.

The method for obtaining a standard deviation of correlated left and right channel content is described in more detail in FIG. 3. The method includes constructing frames of N samples from the right and left channels 16 at step 100, band limiting each frame at step 102, processing the band limited frames by the LMS filter generating a correlated signal at step 104, taking absolute values of the correlated signal at step 106, normalizing the absolute values by the frame loudness at step 108, constructing an envelope of the normalized values at step 110, searching the envelope for peaks above a threshold at step 112, and computing a standard deviation of the separation of the peaks at step 114. The peak threshold may be determined by processing a wide variety of audio content including movies, TV program materials, music CD's, gameplay videos from YouTube etc. The signal envelope 24 may be observed for peaks values for different content to determine a threshold for the peak finder.

Figure 4:
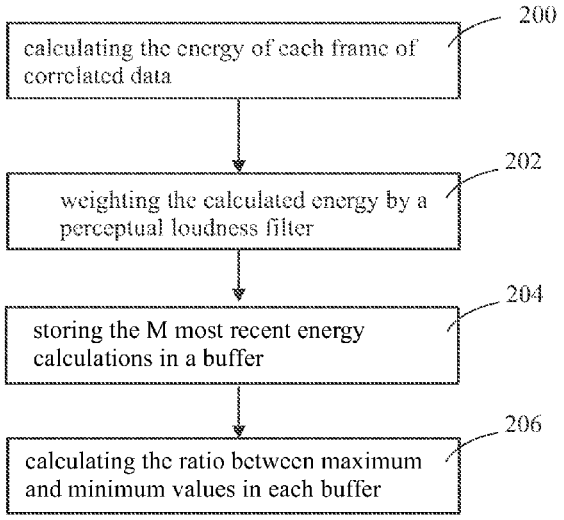
FIG. 4 is a method for calculating a ratio between maximum and minimum values in recent data buffers according to the present invention.

A method for calculating a ratio between maximum and minimum values in recent data buffers is described in FIG. 4. The method includes calculating the energy (RMS value) of each frame of correlated data 20 at step 200, weighting the calculated energy by a perceptual loudness filter (to obtain a measure of the loudness perceived by the typical human) at step 202, storing the M most recent energy calculations in a buffer (the length M of the buffer is dictated by the longest gap between the syllables in speech, typically 16 frames of data) at step 204; calculating the ratio between maximum and minimum values in each buffer at step 206. If this ratio corresponds to the dynamic range characteristic of speech, it is another indication that the input signal is speech content. Typically, the dynamic range is computed from the last 16 stored energy calculations, the ratio between the largest and smallest value in the buffer is determined. When the input signal 12 includes speech, this ratio is higher due to the loud(voiced) and soft(unvoiced) sections of the speech. When the input signal 12 does not include speech, the ratio is low due to the small difference between the loud and soft sections.

Figure 5:
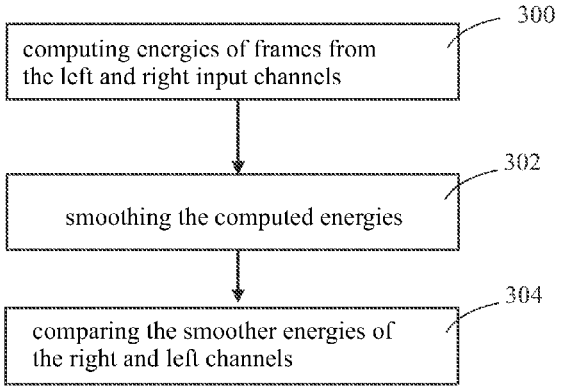
FIG. 5 is a method for computing and comparing smoothed energies of the frames from the left and right input channels according to the present invention.

A method for computing and comparing smoothed energies of the frames from the left and right input channels is described in FIG. 5. The method includes computing energies of frames from the left and right input channels at step 300, smoothing the computed energies at step 302, and comparing the smoother energies of the right and left channels at step 42. Similar (e.g., highly correlated) left and right channel smoothed energies is indicative of speech. Dissimilar (e.g., un-correlated content) left and right channel smoothed energies is indicative of non-speech material.

Figure 6:
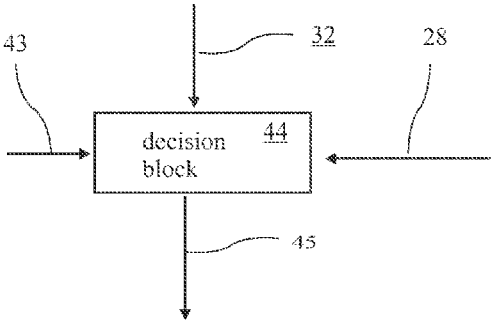
FIG. 6 is a method for making a speech/music classification according to the present invention based on the standard deviation of correlated left and right channel content, the ratio between maximum and minimum values in recent data buffers, and the smoothed energies of the frames from the left and right input channels.

The method 44 for making a speech/music classification based on the peak separation flag or score 28, the loudness ratio flag or score 32, and the left-right channel energy flag or score 43, is shown in FIG. 6. The results of the three tests are compared to set a speech flag 45. Preferably, when two of the three tests indicate that speech is present, the speech flag 45 is set to TRUE for the current batch of data. More preferably, a weighted score based on the three tests is compared to a threshold, if the score exceeds the threshold, the speech flag 45 is set to TRUE for the current batch of data.

While the invention herein disclosed has been described by means of specific embodiments and applications thereof, numerous modifications and variations could be made thereto by those skilled in the art without departing from the scope of the invention set forth in the claims.

We claim:

1. A method for speech versus non-speech classification, comprising:

receiving a two channel signal;

computing a standard deviation of the separations between peaks in correlated content of the two channel signal;

computing a loudness ratio of minimum and maximum values of recent data frames;

computing a comparison of the energies of the two channels of the two channel signal;

classifying the input signal content as speech or as non-speech based on the standard deviations, the loudness ratio, and the comparison of the energies of the right and left channels;

providing the classification to signal processing for the two channel signal;

processing the two channel signal based on the classification of the two channel signal;

providing the processed signal to at least one transducer;

transducing the two channel signal by the at least one transducer to produce sound waves.

2. The method of claim 1, wherein the processing the two channel signal based on the classification comprises processing the two channel signal using frequency based equalization selected based on the classification of the two channel signal.

3. The method of claim 1, wherein computing standard deviations of the separations between peaks in correlated content of the two channel signal, comprises:

constructing frames of N samples from the two channel signal;

band-pass filtering the frames of the two channel signal to produce frames of band-pass filtered signals;

processing the frames of band-pass filtered signals to generate frames of correlated signals;

taking absolute values of the frames of correlated signals;

normalizing the absolute values by frame loudness;

computing an envelope of the normalized values;

searching the envelope for peaks above a threshold; and finding standard deviations of the separations between the peaks.

4. The method of claim 3, wherein determining the correlated content of the two band-pass filtered signals to obtain the correlated content signal comprises processing the two band-pass filtered signals using a Least Means Squared (LMS) filter.

5. The method of claim 1, wherein computing the loudness ratio of minimum and maximum values of recent data frames comprises:

constructing frames of N samples from the two channel signal;

band-pass filtering the frames of the two channel signal to produce frames of band-pass filtered signals;

processing the frames of band-pass filtered signals to generate frames of correlated signals;

calculating the energy of frames of correlated signals;

weighting the calculated energy by a perceptual loudness filter;

storing the M most recent energy calculations in a buffer; and calculating the ratio between maximum and minimum values in each buffer.

6. The method of claim 1, wherein computing a comparison of the energies of the two channels of the two channel signal comprises:

computing energies of frames of the left and right input channels;

smoothing the computed energies; and comparing the smoother energies of the right and left channels.

7. The method of claim 1, wherein:

computing a standard deviation of the separations between peaks in correlated content of the two channel signal includes setting a peak separation flag based on the standard deviation;

computing a loudness ratio of minimum and maximum values of recent data frames includes setting a loudness ratio flag based on the loudness ratio;

computing a comparison of the energies of the two channels of the two channel signal includes setting a left-right channel energy flag based on the comparison of the energies;

classifying the input signal content as speech or as non-speech based on the peak separation flag, the loudness ratio flag, and the left-right channel energy flag.

8. The method of claim 1, wherein:

computing a standard deviation of the separations between peaks in correlated content of the two channel signal includes setting a peak separation score based on the standard deviation;

computing a loudness ratio of minimum and maximum values of recent data frames includes setting a loudness ratio score based on the loudness ratio;

computing a comparison of the energies of the two channels of the two channel signal includes setting a left-right channel energy score based on the comparison of the energies;

classifying the input signal content as speech or as non-speech based on the peak separation score, the loudness ratio score, and the left-right channel energy score.

9. A method for speech versus music classification, comprising:

receiving a two channel signal;

computing standard deviations of the separations between peaks in correlated content of the two channel signal, comprising:

constructing frames of N samples from the two channel signal;

band-pass filtering the frames of the two channel signal to produce frames of band-pass filtered signals;

processing the frames of band-pass filtered signals to generate frames of correlated signals;

taking absolute values of the frames of correlated signals;

normalizing the absolute values by frame loudness;

computing an envelope of the normalized values;

searching the envelope for peaks above a threshold;

finding standard deviations of the separations between the peaks; and setting a peak separation flag or score based on the standard deviation;

computing a loudness ratio of the correlated content signal, comprising:

calculating the energy of frames of correlated signals;

weighting the calculated energy by a perceptual loudness filter;

storing the M most recent energy calculations in a buffer;

calculating the ratio between maximum and minimum values in each buffer; and setting a loudness ratio flag or score based on the loudness ratio;

computing a comparison of the energies of the two channels of the two channel signal, comprising:

computing energies of frames of the left and right input channels;

smoothing the computed energies;

comparing the smoother energies of the right and left channels; and setting a left-right channel energy score based on the comparison of the smoother energies;

classifying the input signal content as speech or as non-speech based on the peak separation flag or score, the loudness ratio flag or score, and the left-right channel energy flag or score;

providing the classification to signal processing for the two channel signal;

processing the two channel signal based on the classification of the two channel signal;

providing the processed signal to at least one transducer;

transducing the two channel signal by the at least one transducer to produce sound waves.

10. The method of claim 9, wherein the processing the two channel signal based on the classification comprises processing the two channel signal using frequency based equalization selected based on the classification of the two channel signal.

11. A method for speech versus music classification, comprising:

receiving a two channel signal;

computing standard deviations of the separations between peaks in correlated content of the two channel signal, comprising:

constructing frames of 52 samples from the two channel signal;

band-pass filtering the frames of the two channel signal to produce frames of band-pass filtered signals;

processing the frames of band-pass filtered signals using an LMS filter to generate frames of correlated signals;

taking absolute values of the frames of correlated signals;

normalizing the absolute values by frame loudness;

computing an envelope of the normalized values;

searching the envelope for peaks above a threshold;

finding standard deviations of the separations between the peaks; and setting a peak separation flag or score based on the standard deviation;

computing a loudness ratio of the correlated content signal, comprising:

calculating the energy of frames of correlated signals;

weighting the calculated energy by a perceptual loudness filter;

storing the M most recent energy calculations in a buffer;

calculating the ratio between maximum and minimum values in each buffer; and setting a loudness ratio flag or score based on the loudness ratio;

computing a comparison of the energies of the two channels of the two channel signal, comprising:

computing energies of frames of the left and right input channels;

smoothing the computed energies;

comparing the smoother energies of the right and left channels; and setting a left-right channel energy score based on the comparison of the smoother energies;

classifying the input signal content as speech or as non-speech based on the peak separation flag or score, the loudness ratio flag or score, and the left-right channel energy flag or score;

providing the classification to signal processing for the two channel signal;

processing the two channel signal using frequency based equalization selected based on the classification of the two channel signal;

providing the processed signal to at least one transducer;

transducing the two channel signal by the at least one transducer to produce sound waves.

* * * * *